US005570823A

United States Patent [19]

Lindy

[11] Patent Number: 5,570,823

[45] Date of Patent: Nov. 5, 1996

[54] BABY CARRIER

[76] Inventor: Elaine Lindy, 897 Washington St., Newtonville, Mass. 02160

[21] Appl. No.: 498,037

[22] Filed: Jul. 5, 1995

Related U.S. Application Data

[63] Continuation-in-part of Ser. No. 198,966, Feb. 18, 1994, abandoned.

[51] Int. Cl.[6] ..... A47D 13/02

[52] U.S. Cl. ..... 224/160; 224/159; D3/214; D3/213

[58] Field of Search ..... 224/158, 159, 224/160, 161, 208, 209, 202, 204, 259, 184; 2/48, 51, 52; 434/395; D3/213, 214

[56] References Cited

U.S. PATENT DOCUMENTS

| | | | |
|---|---|---|---|
| D. 253,558 | 12/1979 | Carter | D3/214 |
| D. 307,821 | 5/1990 | Fallon | 224/159 |
| D. 357,800 | 5/1995 | Roan et al. | D3/213 |
| 2,550,851 | 5/1951 | Nichols . | |
| 2,599,474 | 6/1952 | Mills | 224/160 |
| 3,152,738 | 10/1964 | Worsfold, Jr. | 224/259 |
| 3,229,873 | 1/1966 | Hershman | 224/160 |
| 3,350,720 | 11/1967 | Freund | 2/48 |
| 3,501,074 | 3/1970 | Emerick | 224/204 |
| 3,780,919 | 12/1973 | Hanson . | |
| 4,234,229 | 11/1980 | Arnold | 297/467 |
| 4,253,197 | 3/1981 | Posta | 434/395 |
| 4,271,998 | 6/1981 | Ruggiano | 224/160 |
| 4,402,440 | 9/1983 | Purtzer et al. | 224/159 |
| 4,434,920 | 3/1984 | Moore | 224/160 |
| 4,467,945 | 8/1984 | Schaapveld | 224/160 |
| 4,492,326 | 1/1985 | Storm | 224/160 |
| 4,579,264 | 4/1986 | Napolitano | 224/160 |
| 4,606,078 | 8/1986 | Tkacsik | D3/214 |
| 4,724,987 | 2/1988 | Maheu | 224/159 |
| 4,724,988 | 2/1988 | Tucker | 224/160 |
| 4,903,873 | 2/1990 | Poole et al. | 224/158 |
| 5,020,709 | 6/1991 | Hoagian | 224/160 |
| 5,071,047 | 12/1991 | Cordisco | 224/158 |
| 5,082,289 | 1/1992 | Paranto et al. | 2/52 |
| 5,246,152 | 9/1993 | Dotseth | 224/158 |
| 5,361,952 | 11/1994 | Gold | 224/159 |

FOREIGN PATENT DOCUMENTS

| | | | |
|---|---|---|---|
| 2026848 | 2/1980 | United Kingdom | 224/158 |

*Primary Examiner*—Henry J. Recla
*Assistant Examiner*—Gregory M. Vidovich

[57] ABSTRACT

A flexible, lightweight baby carrier that positions a baby to see frontward over the bearer's shoulders. The baby is supported at a height where the baby's head reaches the level of the bearer's facial features. The carrier is comprised of a pouch (10) having a head & back support (12), leg openings (16), a pair of extension straps (22), a pair of lifting straps (24), and a pair of side panels (18); also a pair of shoulder straps (26), a pair of underarm straps (32), and a backpiece (28). The shoulder straps (26) are connected at one remote end to pouch (10) and at the other remote end, behind the bearer's neck, to one another at a substantially inflexible location. Thus, a predetermined length for the shoulder straps is created. This predetermined length causes pouch (10) to be suspended on the bearer's body at the desired height. The baby can be quickly and accurately placed without the need for the bearer to first find the correct shoulder strap length. The lifting straps adjustably and diagnolly connect from the baby's diapered bottom to side panels (18) so that when lifting strap (24) is shortened and thus tightened, the baby can be further raised with maximum leverage. A detachable newborn headrest (34) is provided to support sideways head roll.

15 Claims, 4 Drawing Sheets

BABY CARRIER

This is a continuation-in-part of U.S. application Ser. No. 08/198,966 filed 18 Feb. 1994, now abandoned.

BACKGROUND—FIELD OF INVENTION

This invention relates to a baby carrier, specifically to the type which holds a baby in front of a bearer.

BACKGROUND

Frontal carriers are typically utilized from birth until the baby becomes to heavy to support, at about four months of age. By that time, most babies have learned to hold their heads upright with sufficient strength to be moved into a back-mounted carrier. Back-mounted carriers are recommended for carrying babies from about four months old to toddler age.

The chief benefits of frontal carriers are that the bearer and the baby can together enjoy the warmth of frontal contact, with the baby feeling the heart beating. In traditional frontal carriers, the top of the baby's head reaches at or below the neck level of the bearer. The bearer can see and stroke the baby from head to toe.

Nevertheless, both baby and bearer often tire quickly of the device. The sheer weight of the baby causes a strain on the bearer's lower back that only increases as the little one gains weight. Though we'll never know for certain what babies feel, it's reasonable to presume their view, limited as it is to the designs on the bearer's shirt and whatever side vision can be mustered, is frustrating to them. Parents often attest that a squirming and fussing baby lifted from a frontal carrier to a view over the shoulders is soon quieted.

There are additional disadvantages of frontal carriers. In most cases the bearer needs to hold the frontal carrier with one hand to keep it from swinging about. As a result, tasks requiring the use of both hands must wait. Moreover, the baby visually blocks the volume in front of the bearer's stomach where the bearer typically handles items, thus hindering the bearer's freedom to work.

Back-mounted carriers correct many of the problems of frontal carriers. They offer an improved view of the world to the older baby and alleviate lower back strain to the bearer. They free the bearer's arms and hands and allow the bearer to perform tasks in front of the body. But back-mounted carriers have disadvantages also. They can be used only after a baby is about four months of age, after sufficient head support has developed. Frontal contact is sacrificed. The bearer cannot see the baby since it is behind the bearer. What's more, the bearer cannot touch the baby, except perhaps for its dangling feet.

Heretofore no device has been proposed that safely and effectively incorporates the stated advantages of a back-mounted carrier within a frontal carrier designed for the first few months of life. No device has been proposed that maintains the warmth of chest-to-chest contact with the baby and full view of head to toe typical of frontal carriers, together with an expanded view of the world for the baby, alleviated back strain to the bearer, full use of both the bearer's arms and hands, and wide enough range for the bearer in front of the stomach area to perform necessary tasks.

OBJECTS AND ADVANTAGES

Accordingly, several objects and advantages of the present invention are:

(a) To provide a frontal baby carrier that maintains the warmth of frontal contact and allows the bearer to see the baby from head to toe.

(b) To provide a frontal baby carrier where the baby is secured in complete safety;

(c) To provide a frontal baby carrier that affords as wide a view to the baby as a back-mounted carrier allows;

(d) To provide a frontal carrier where lower back strain is relieved and the weight of the baby is borne comfortably and evenly by the strength of the bearer's upper back and shoulders;

(e) To provide a frontal baby carrier where the bearer need not hold onto the carrier and can enjoy full use of both arms and hands;

(f) To provide a frontal baby carrier where the bearer can see and access the volume in front of the stomach and thus can perform a number of tasks requiring use of that volume; and (g) To provide a frontal baby carrier where the baby is quickly and accurately placed, thereby providing an agreeable transition to the baby so the above benefits can be realized.

Further objects and advantages are to provide a frontal carrier that can be positioned on either the left or the right shoulder of the bearer interchangeably, to provide a frontal carrier that is easy for the bearer to put on and take off and requires no fastening connections, to provide a frontal carrier that provides sufficient head support for the newborn baby's backward head movement as well as sideward roll, and to provide a frontal carrier that is simple and economical to manufacture.

Still further objects and advantages will become apparent from a consideration of the ensuing description and drawings.

SUMMARY OF DESIGN

The present invention accomplishes the above-stated objects and advantages by securing the baby high enough upon the bearer's body for the baby to see over the bearer's shoulder. The baby's head reaches the height of the bearer's facial features. The baby can be supported at this elevated position because the length of the shoulder straps is predetermined to create such a height. The shoulder straps are individually affixed to the pouch at one end, and at the other end they are connected behind the bearer's neck to one another at a location that is substantially inflexible. Thus, the correct length for the shoulder straps is automatically provided. The bearer need not fumble with adjustments or connections to find the correct strap length. As a result, the baby can be quickly and accurately placed at the desired height. Only with such quick and accurate placement will the typical baby, easily frustrated and impatient for comfort, cooperatively agree to being placed at the elevated height at all.

The elevated position allows a wide, ever-changing view that most babies will find more captivating than the printed designs or plainness of the bearer's shirt or other chest area. As a result, babies will remain contentedly in place for a longer time. Lower back strain to the bearer will be relieved. This is because the baby rests across from the bearer's upper back, and therefore the baby's weight is borne primarily by the bearer's lower back muscles. Both arms of the bearer will be free. This is because the baby will be closely secured around the bearer's body. The area in front of the bearer's stomach will be visible and the bearer will be able to perform essential tasks requiring that range of vision. This is because, again, the baby is elevated to shoulder level.

The essential components of the present invention comprise a pouch that supports a baby in front of a bearer, a central closure within the pouch, a backpiece covering the bearer's shoulder blade region, two shoulder straps that reach from the pouch to the backpiece, two underarm straps that reach from the backpiece under the bearer's arms to the pouch, two lifting straps upon the pouch, and a detachable newborn headrest that supports sideways head roll.

Frontal carriers heretofore, in which the top of the baby's head reaches at or below the bearer's neck, contain either fixed length or adjustable length shoulder straps. In neither design can the bearer place the baby quickly and accurately at the described height achieved by the present invention.

In carriers to date having fixed length shoulder straps, the shoulder straps are not connected behind the bearer's neck at a substantially inflexible location that creates a strap length which causes the baby's head to reach the level of the bearer's facial features. Thus the pouch height provided in the present invention is not achievable.

In carriers with adjustable length shoulder straps, it may be possible to shorten the shoulder straps to reach the pouch height provided in the present invention, however the bearer cannot quickly and accurately accomplish this task. No substantially inflexible location exists that automatically defines where the adjustment of the strap should end. The bearer must fumble to locate the correct strap length, all the while knowing that babies, typically sensitive to handling and impatient for comfort, are frustrated by delay. In mere seconds, a mild level of anxiety can suddenly accelerate to where a baby becomes inconsolable. Pressure on the bearer is exacerbated all the more since inaccurate adjustments will cause the carrier to be held imperfectly—too high, too low, or evenly. If due to inaccurate adjustments, the baby must be removed from the carrier, forced to wait indefinitely, only to be picked up and juggled all over again, the baby is likely to refuse to be placed within the carrier not only that time, but thereafter as well.

U.S. Pat. No. 3,229,873 to Hershman (1966) teaches a vertically severable, single-panel frontal carrier with adjustable shoulder straps where the top of the baby's head reaches the bearer's neck. No suggestion exists in Hershman that its shoulder straps should connect behind the bearer's neck at a predetermined and inflexible location that creates a strap length which causes the pouch to be suspended at such a height that the baby's head reaches the level of the bearer's facial features. Indeed, if the pouch were so raised, the Hershman reference would become patently unsafe because the baby would tip or even slip through the single-panel structure.

U.S. Pat. No. 4,903,873 to Poole (1990) teaches a loose and full frontal carrier with adjustable shoulder straps, designed for use in an aqueous environment, where the top of the baby's head reaches below the bearer's neck. No suggestion exists in Poole, either, for its shoulder straps to be connected at a predetermined and inflexible location that defines a strap length provided in the present invention. If the pouch were so raised, the baby would unsafely tip within the pouch's oversized top and leg openings.

U.S. Pat. No. 357,800 to Roan (1995) similarly teaches a frontal carrier with adjustable shoulder straps where the top of the baby's head is extrapolated to lie at or below the bearer's neck. Roan lacks any suggestion as well that its shoulder straps should be connected at a predetermined and inflexible location that creates the strap length necessary for the described pouch height. Moreover, if Roan's pouch were raised to where a baby could see over the bearer's shoulder, the baby would be prevented from being placed in the carrier at all because no central closure exists to allow ease of access and removal at the elevated position.

Importantly, given the adjustable shoulder straps extant in Hershman, Poole, and Roan, a bearer is forced to manually search for the correct strap length. This potentially tedious process burdens and stresses both bearer and baby.

Unlike adjustments in the height of traditional frontal carriers, where the baby held in front of the bearer's stomach can be cradled against the bearer's body while the bearer makes adjustments to the overall height of the carrier, the process of adjusting the overall height of a carrier supporting a baby at shoulder level is unacceptably oppressive to the typical baby. The baby must first be gripped by the fingers of one hand at the desired height upon one shoulder while the bearer tries with his or her free hand to adjust the shoulder strap on the other side to its correct length. Then the baby must be moved to the other shoulder, requiring a shift of hands to support the baby, so that the other shoulder strap can be adjusted as well to its correct length. If the baby were not moved to the other shoulder, a shift of hands would still be necessary, and the adjustment motion would have to take place uncomfortingly close to the baby's face. Regardless, the baby immediately dislikes the sense of diminished security from being supported by the fingers of one hand only, and the baby's alarm is compounded by the shifting of support from one hand to another, the indefinite delay, the unexpected appearance of fingers, knuckles and hands as the bearer makes adjustments on opposite sides of the baby, and also by the sense that the bearer's attention is distracted away from the baby and toward the various adjustment motions.

The process is no easier if the bearer attempts to make the shoulder strap adjustments first, before placing the baby within the carrier. Because the correct strap length is not predesignated as in the present invention, and because traditional frontal carriers are designed to position a baby where its head reaches at or below the bearer's neck, then the bearer must guess how short to adjust the shoulder straps so that a baby is positioned where its head will reach the bearer's facial features. Besides compelling the baby to wait indefinitely while the bearer's attention is focused on guessing at correct strap length, the bearer assumes the risk that the selected strap length will be too high, too low, or uneven. Any of these events will necessite removing the baby from the carrier and trying again, a prospect the baby will find even less appealing.

In contrast, applicant's novel frontal carrier assures that the baby is quickly and accurately placed at shoulder level. Insodoing, optimal assurance is provided that the baby will cooperatively agree to be placed within the carrier. Only then, that is with a cooperative and agreeable baby, can the described benefits resulting from the elevated position be realized.

DRAWING FIGURES

REFERENCE NUMERALS IN DRAWINGS

Figure 1:
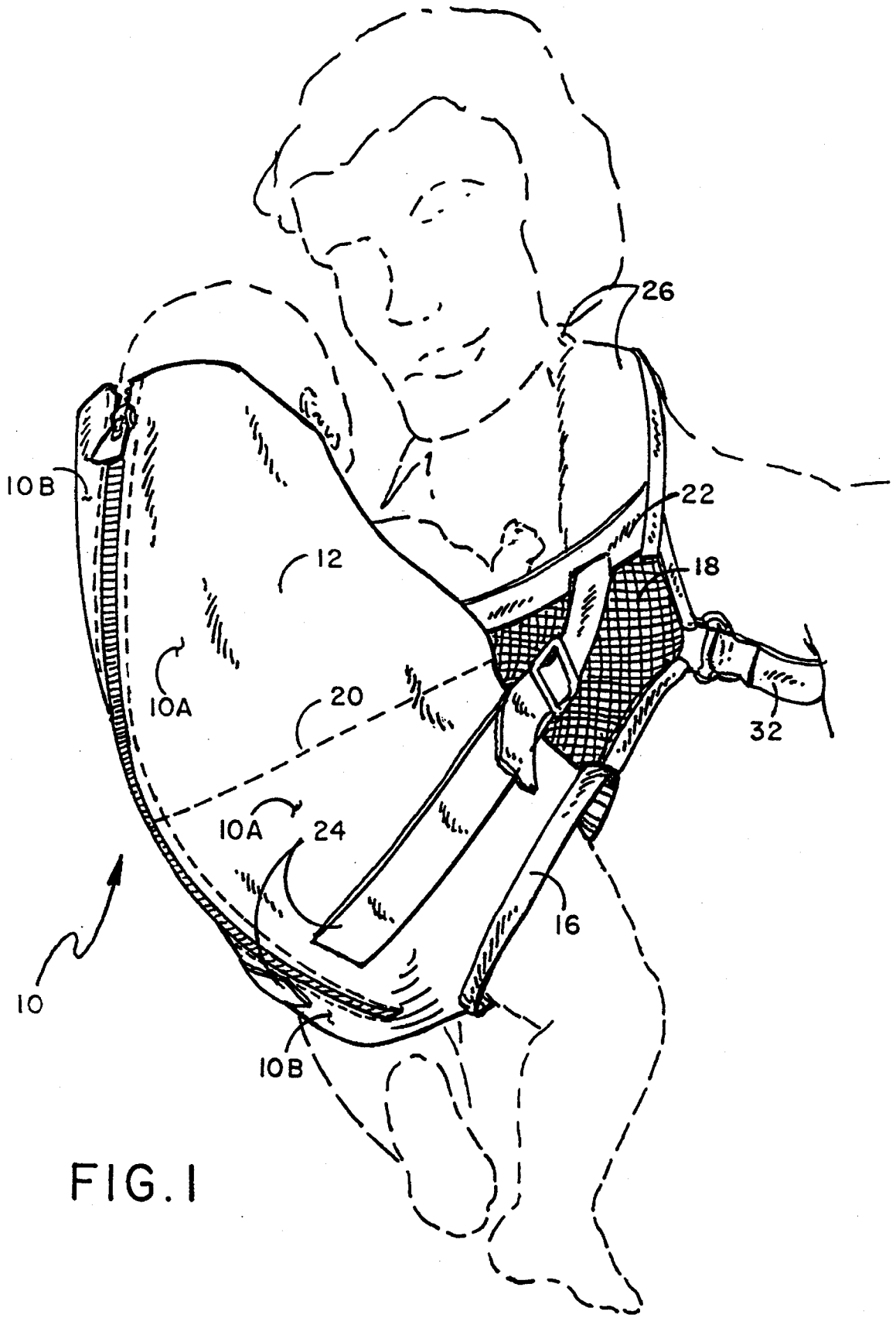
FIG. 1 is a frontal perspective of a baby carrier in accordance with my invention.

10 pouch
- 10A flexible half section, left
- 10B flexible half section, right
- 12 head & back support

14 central zipper
16 leg openings
18 side panels
20 midline axis
22 extension strap
24 lifting straps
26 shoulder straps
28 backpiece
- 30 decoration

32 underarm straps
34 newborn headrest
- 36 loops
- 38 fasteners
- 40 cord-lock
- 42 elastic lengths

DESCRIPTION—FIGS. 1 TO 5

A description of the carrier begins with a pouch 10 having a close-fitting interior into which a baby can be supported against a bearer's chest.

Figure 5:
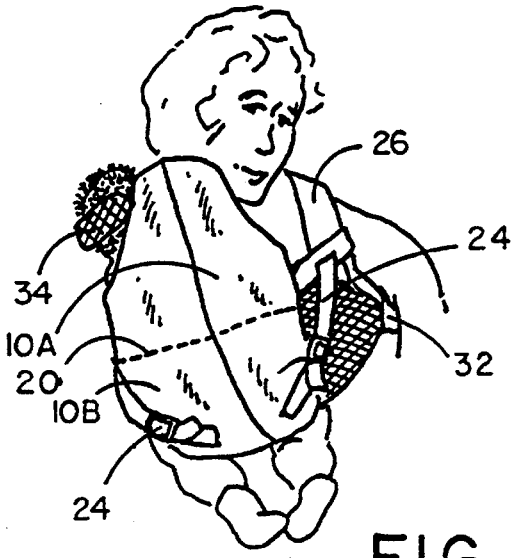
FIG. 5 is a front view of a bearer holding a baby in the carrier and also showing the newborn headrest.

FIG. 1 illustrates the height of the baby when positioned within the baby carrier. Notice that the baby's head reaches the level of the bearer's facial features. Notice also that midline axis 20 extends at substantially the same level as the armpits of the bearer. Similarly, FIG. 5 illustrates the height of a smaller newborn baby supported within the pouch. Notice that the newborn's head also reaches the level of the bearer's facial features, and that midline axis 20 extends at substantially the same level as the armpits of the bearer.

Figure 2:
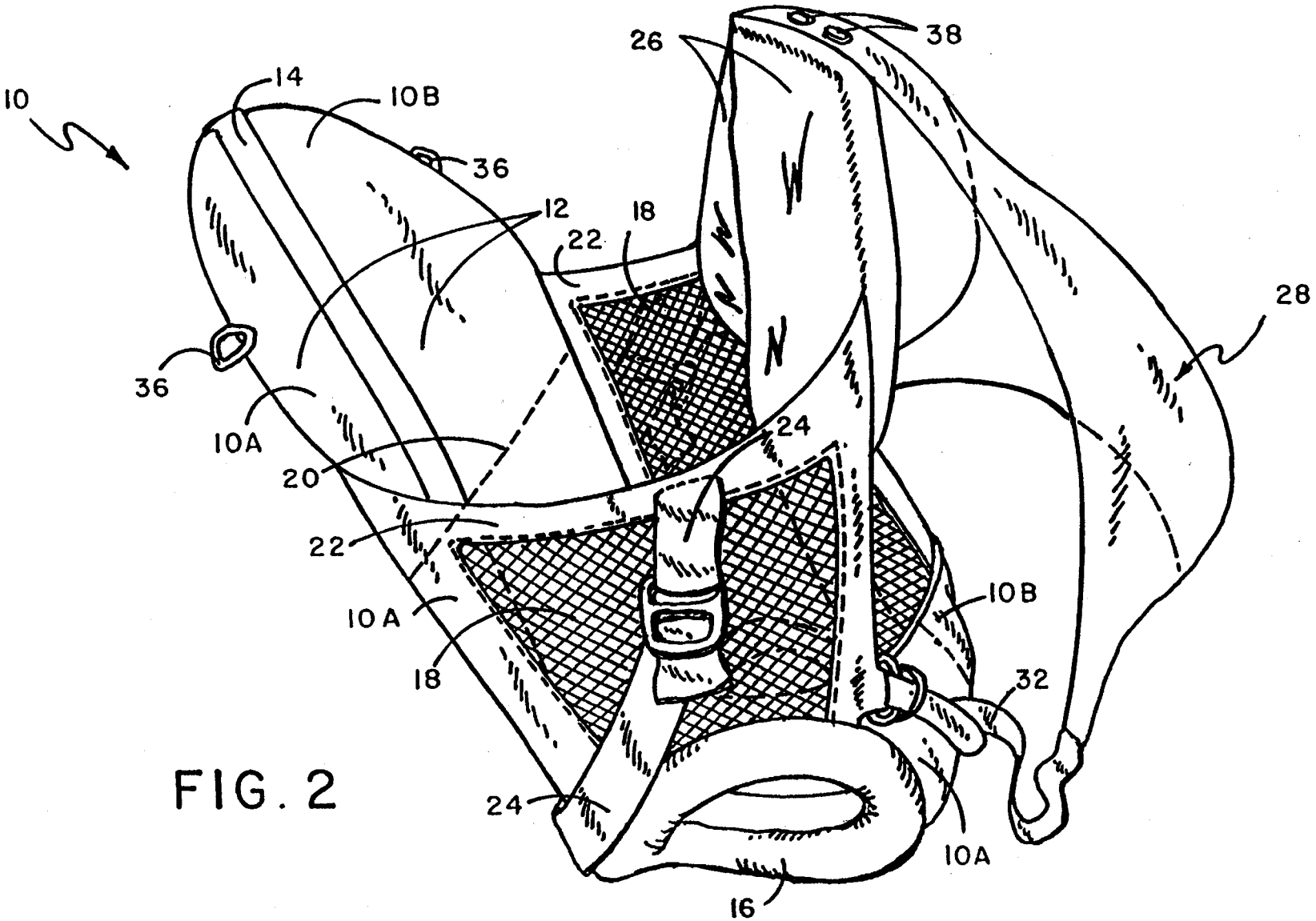
FIG. 2 is a side view of a baby carrier in accordance with my invention.

FIG. 2 details the elements of the invention. Pouch 10 is composed of two flexible half sections, left half section 10A and right half section 10B that are partially severable and joinable along central zipper 14. Each flexible half section is divisible by a midline axis 20 into an upper portion and a lower portion, Within the lower portion are leg openings 16.

Pouch 10 connects in two ways to a bracing means strapped around the back of the bearer. In the present embodiment, the bracing means is a backpiece 28. Backpiece 28 connects over the bearer's shoulders by way of shoulder straps 26 and also connects under the bearer's arms and above the bearer's breasts by way of underarm straps 32.

Each flexible half-section 10A and 10B is further composed of head & back support 12, a resilient member having impact absorbency. Support 12 is made of either a thick, dense foam material, a lighter foam material backed by a hard yet flexible plastic, or a like construction technique that provides a soft and comfortable as well as secure surface against which the baby can rest. Support 12 is divisible along midline axis 20 into an upper half and a lower half. The tops of each flexible half-section 10A and 10B are slanted inwardly. This is because a square-edged top could obstruct the bearer's frontward vision.

Central zipper 14 ends at a predetermined point between leg openings 16 (FIG. 1). Zipper 14 is of a heavy gauge and is prefereably made of plastic, rather than the harder-edged metal.

In the preferred embodiment, a flap of fabric is provided along zipper 14 inside pouch 10 to prevent the zipper tab from catching tender baby skin. In addition, an oversized tab grabber enables the bearer to easily locate the zipper tab and pull it up or down.

Within the lower portion of each flexible half section 10A and 10B the weight of the baby rests. Leg openings 16 have padded rib edges.

The parts of pouch 10 are additionally described as follows: a pair of extension straps 22, a pair of lifting straps 24, and a pair of side panels 18.

Extension straps 22 are individually joined at one end to the upper half of support 12 above midline axis 20, extend laterally and are joined at the other end to shoulder strap 26. Extension strap 22 rises where joined to shoulder strap 26. This rise strengthens the connection from pouch 10 to shoulder straps 26.

Lifting straps 24 are individually attached at one end to the lower half of support 12 (FIGS. 1 & 5), rise diagnolly and are attached at the opposite end to extension strap 22 at about the respective midpoint. Specifically, within the lower half of support 12, lifting straps 24 are attached on corresponding sides of zipper 14, about where zipper 14 ends at leg openings 16. Pulling downward upon either right or left lifting straps 24 shortens its length, consequently raising and angling the baby carrier. Because lifting straps 24 cross the area of baby's greatest weight, the baby's position can be shifted with maximum leverage to the bearer. Thus, disruption to the baby is minimized. Also serving to reduce disruption to the baby is the reach of the hands around the baby, which is not a surprising or disturbing motion, and also the direction of the bearer's attention, which is comfortingly focused toward the baby.

Each lifting strap 24 is composed of three parts: an anchored section, a fastener, and an adjusting section The anchored section is joined at one end to extension strap 22. The fastener is a double-slotted or similar device that allows the anchored section to pass through and be fixed upon itself, and from the opposite direction allows the adjusting section to pass through and end freely. By pulling upon and releasing the free end of the adjusting section, lifting strap 24 is accordingly shortened or lengthened.

A pair of rectangularly shaped side panels 18 are located between support 12 and shoulder strap 26. Side panels 18 are bordered respectively along the top by extension strap 22, along the bottom by leg opening 16, along one side by the lower half of support 12, and along the opposite side by the lower section, hereinafter described, of shoulder strap 26. Side panels 18 are substantially constructed of mesh material to improve ventilation since the pouch occupies an area directly beneath the bearer's chin. Also, the mesh material expands visual range for baby and bearer alike.

Observe that pouch 10 in its entirety provides a solid, strong, permanently-positioned body of material surrounding the baby. This feature contributes to safety and security. Further, alla fasteners and adjustment features do not contact the baby and thus cannot create discomfort.

The entirety of the device, excluding fastener hardware, is made of any suitable material, preferably a lightweight, rugged waterproof fabric that is washable.

FIG. 2 also illustrates two shoulder straps 26 having equal length. Shoulder straps 26 reach from pouch 10 over the bearer's shoulders where they are connected behind the bearer's neck to one another. This connection is worn behind the bearer's neck and in the present embodiment, is overlapped by the peaked top of backpiece 28. The location where this connection takes place creates a predetermined strap length, which in turn causes pouch 10 to be suspended at a predetermined height.

Importantly, the location where straps 26 are connected to one another is substantially inflexible. Hence, correct strap length is an automatic feature. The bearer need not fumble adjusting shoulder straps to locate correct strap length.

However, the location where the straps are connected behind the neck cannot be standardized with respect to where the straps are connected to the pouch because the edge of the pouch may extend higher or lower according to carrier design. A more reliable reference is shown when the carrier is worn. Then it becomes apparent that the location where the straps are connected behind the bearer's neck creates a strap length that causes midline axis 20 to extend at substantially the same level as the armpits of the bearer's body.

Described differently, the distance between the location where straps 26 are connected behind the bearer's neck and the base of the leg openings is approximately 38 centimeters.

Shoulder straps 26 are thickly padded in the upper section above extension strap 22 and are more thinly padded in the lower section below extension strap 22. The thinner padding of the lower section minimizes bulk so the baby can snuggle as closely as desired against the bearer's body.

FIG. 2 also illustrates backpiece 28. Backpiece 28 is shown in the present embodiment as having an overall triangular shape. As stated, the peaked top of backpiece 28 overlaps the spot where shoulder straps 26 are connected behind the bearer's neck to one another. Backpiece 28 extends downward over the shoulder-blade area, and therefore helps distribute the baby's weight to the upper back region. The bottom edge of backpiece 28, approximately ten centimeters high, is padded for wearer comfort. Backpiece 28 tapers and its ends blend into underarm straps 32, described hereinafter. It is preferred that both backpiece 28 and underarm straps 32 be colored distinctly from the rest of the carrier so the bearer can easily find the free ends of underarm straps 32 and distinguish these from the free ends of lifting straps 24.

Figure 3:
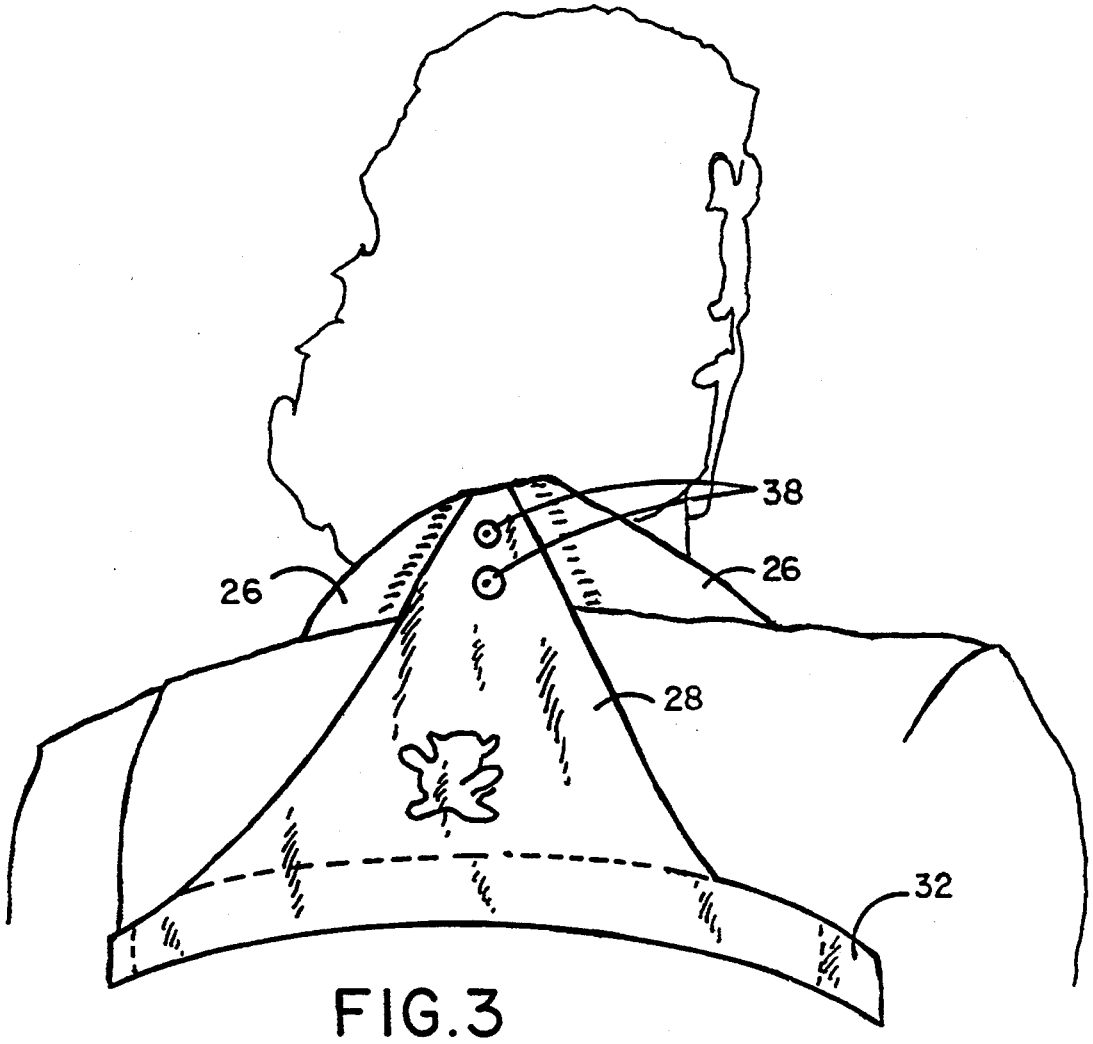
FIG. 3 is a rear view of the carrier showing how shoulder straps are connected to a backpiece of the carrier.

On the side of backpiece 28 that faces outward, in a central location, is a backpiece decoration 30, as shown in FIG. 3. Decoration 30 should be a single figure that has a clear directional orientation, for example a waving bear or a smiling sun. This will help the bearer orient the device proper side up in preparation of harnessing it upon the body.

Finally, FIG. 2 illustrates underarm straps 32. The underarm straps 32 connect backpiece 28 under each arm to the lower portion of flexible half sections 10A and 10B, respectively. When worn by a bearer, underarm straps 32 extend in a horizontal direction above the breast line as indicated in FIGS. 1 & 5. This design secures the lower portion of each flexible half section against the bearer's body, and in so doing helps distribute the baby's weight to the bearer's upper back and shoulders.

Similar to lifting strap 24, each underarm strap 32 is composed of three parts: an anchored section, a fastener, and an adjusting section. The anchored section is secured to a predetermined point at the lower portion of each flexible half section, and is fixed thereafter upon itself. The fastener, a double-ringed or like device, allows the anchored section to pass through from one direction and the adjusting section, joined as before to the tapered end of backpiece 28 to pass through from the opposite direction and end freely. By tightening or loosening the free end of the adjusting section, the length of underarm strap 32 is adjusted to fit.

FIG. 3 provides a rear view of the carrier.

This figure shows the manner in which shoulder straps 26 are joined to backpiece 28, a feature important to the comfort of the bearer. Observe that backpiece 28 is substantially perpendicular in relation to straps 26. This relationship helps restrain straps 26 from squeezing the bearer's neck in response to the downward force of the baby in front of the bearer. Thus, the weight of the baby is transferred away from the bearer's neck to the bearer's shoulders and upper back region, where greater strength lies. The opposing ends of the each of the shoulder straps are attached to the backpiece and the pouch, respectively, by means of stitching.

Figure 4:
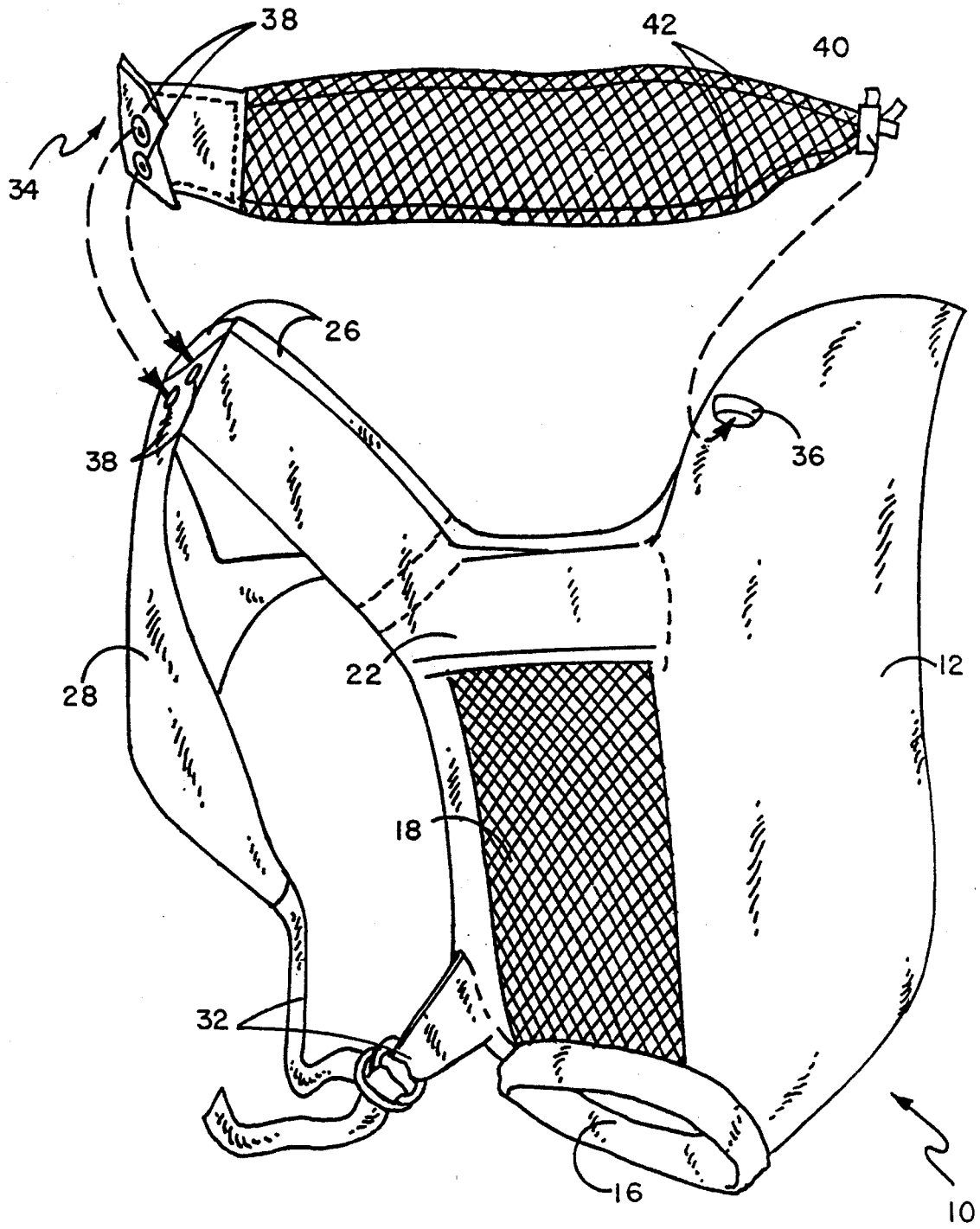
FIG. 4 is a side view of the carrier with an unattached newborn's headrest.

FIG. 4 illustrates a newborn headrest unattached to the baby carrier.

Newborn headrest 34 is a detachable feature that provides sideways head support for the baby up to approximately three months old, a time when an infant's head will roll sideways as well as backward. The present embodiment has an elongated section of material that can swing interchangeably to either side of the baby's head.

One end of headrest 34 is detachably connected to the baby carrier onto the area behind the bearer's neck where backpiece 28 overlaps shoulder straps 26. The opposite end of headrest 34 swings around either side of the baby's head, and connects into loops 36 located on respective upper portions of flexible half sections 10A and 10B. After the baby develops sufficient neck strength to hold the head upright, headrest 34 can be removed altogether. Fasteners 38 such as snap fasteners are shown at one end of headrest 34 and correspondingly where the peaked top of backpiece 28 overlaps straps 26 (FIG. 3).

The end of headrest 34 that is detachably connected behind the bearer's neck extends in a forked shape, and fasteners 38 are located within the outside face of the forked shape. Thus, the forked shape masks fasteners 38 from view.

Headrest 34 includes an adjusting means, whereby a baby supported within said pouch can be drawn closer to the body of the bearer. In the present embodiment, the adjusting means is comprised of two lengths of elastic 42 embedded laterally along the upper and lower edges of headrest 34 and that are joined together through cord-lock 40.

The elongated section of headrest 34 is made substantially of mesh material to improve both ventilation and visual range for baby and bearer.

FIG. 5 shows a bearer holding a newborn baby in the baby carrier with headrest 34 attached.

OPERATION—FIGS. 1 TO 5

Before harnessing the baby carrier, the bearer first locates back piece decoration 30. When the device is held such that decoration 30 is right side up, the baby carrier is properly positioned to be fitted upon the bearer's body.

The bearer's arms are slipped through the space between underarm straps 32 and shoulder straps 26. The bearer's head is slipped underneath the location where shoulder straps 26 are connected to one another. Then the device is pulled downward over the bearer's head and shoulders. Underarm straps 32 are tightened for comfortable fit.

Central zipper 14 is opened and the two halves of support 12 are allowed to fall open. Now it is time to pick up the baby.

The bearer holds the baby against the right or left shoulder, as preferred. The feet of the baby are slipped through leg openings 16. The bearer lightly presses the baby against the bearer's body with one hand, and with the other hand locates the tab grabber and closes zipper 14. The bearer then eases the baby's legs downward, if necessary, through leg openings 16 until the baby's diapered bottom rests between leg openings 16.

When the baby is younger than approximately ten weeks or lighter than approximately five kilograms, the bearer tucks the baby's outer arm inside side panel 18. This helps hold the flaccid infant upright. Otherwise the baby's outer arm moves freely above extension strap 22.

If a smaller baby needs to be raised further and angled to reach optimum position, the bearer applies downward pressure upon lifting strap 24 located on the side of the preferred shoulder. Pulling downward upon lifting strap 24 shortens its length, consequently raising and angling the baby.

An individual bearer usually prefers to hold a baby on either the right or the left shoulder. Thus, once lifting strap 24 by the preferred shoulder is properly adjusted, it can remain so adjusted, needing further adjustment only after the baby grows larger. Note also that while a newborn baby will likely need both lifting straps 24 adjusted for a snug fit, an older baby, one approximately over five kilograms in weight, will likely need only one side adjusted. A baby larger than approximately six to seven kilograms may need no adjustments whatsoever; the mass of the baby will fill the pouch completely and the baby will naturally gravitate to look over one of the bearer's shoulders.

Headrest 34 supports sideways head roll until the baby is able to hold its head upright. The free end of headrest 34 is looped into the preferred left or right flexible half section.

A preferred feature is that the bearer need only adjust two kinds of straps (underarm straps 32 and one lifting strap 24) and one zipper. All adjustable parts are attached to the device and the bearer need not fumble to match a fastener to a corresponding part.

To remove the baby, the bearer first unzips zipper 14. A smaller baby is easy to pull up and out of leg openings 16. A larger baby may need to be rested onto a soft surface such as a sofa or chair so that the baby's legs can be manually freed, if necessary, from leg openings 16. To remove the empty carrier from the bearer's body, the bearer loosens underarm straps 32 and slips shoulder straps 26 forward over the bearer's head. Thus both the baby and carrier are easily removed.

CONCLUSIONS, RAMIFICATIONS, AND SCOPE

Accordingly, it can be seen that my baby carrier successfully incorporates the advantages of a back-mounted carrier within a frontal carrier useable for the first few months of life.

Due to the shoulder level height, the baby can see over the shoulder of the bearer so as to enjoy as wide and ever-changing a view as is available in a back-mounted carrier. Also as a result of the shoulder level position, lower back strain associated with current-day frontal carriers is relieved. Moreover, because the baby is secured snugly against the body of the bearer, both arms and hands of the bearer are freed. Further, the area in front of the stomach is visible and the bearer can thereby perform household tasks requiring that range.

Yet because the pouch rests in front of the bearer, the traditional chest-to-chest contact of the frontal carrier is maintained.

It can also be seen that these advantages are consistently and repeatedly realizable because and only because the baby can be quickly and accurately placed at the proper height. Such quick and accurate placement is ensured by ending the shoulder straps at a predetermined and substantially inflexible location behind the bearer's neck.

The baby carrier is safe and comfortable for the baby. A newborn headrest is featured to support sideward head roll. For the bearer, the baby carrier is easy to put on and to take off. The baby carrier is also convenient as it can be used on either the right shoulder or the left shoulder. Of interest to a manufacturer, the device is lightweight, simple, and economical to construct.

The baby carrier may be embodied in variations and/or other specific forms than that illustrated without departing from the spirit or essential characteristics thereof. For example, the baby can be held more vertically if the leg openings are shifted further to the right or to the left. The carrier as described can also be a life-saving device, or it can carry loads other than babies.

Moreover, although the description above contains many specificities, these should not be construed as limiting the scope of the invention but as merely providing illustrations of some of the presently preferred embodiments of this invention. For example, the straps can be wider or thinner, the fastening means may be buckles, clips, double rings, or hook-and-loop fasteners, the position of the straps may differ, etc. The described pair of shoulder straps connected to one another at one end could be construed as a single length. The shoulder straps, rather than being affixed to the pouch by sewing, could be connected to the pouch at a predetermined and substantially inflexible location. The illustrated embodiment is therefore to be considered in all respects as illustrative and not restrictive.

Thus the scope of the present invention should be determined by the appended claims and their legal equivalents, rather than by the specifics in the description, and all changes which come within the meaning and range of equivalency of the claims are intended to be embraced thereby.

What I claim is:

1. A baby carrier for carrying a baby on a bearer's body such that the baby and the bearer are situated in a face-to-face relationship, said carrier comprising:

a flexible pouch, a bracing means, a pair of shoulder straps and a pair of underarm straps;

said pouch having a substantially close fitting interior for supporting the baby therein in a substantially seated position facing the bearer, said pouch comprising first and second longitudinal half sections which are at least partially severable and joinable along a central closure, each half section being divisible along a substantially horizontal midline axis into an upper portion and a lower portion, said lower portion having leg openings therein;

said bracing means extendable about the back of the bearer;

each of said shoulder straps being of equal, fixed length and having first and second ends, the first end of each said shoulder strap being connected to said upper portion of said pouch and extending upwardly therefrom, the second end of one of said shoulder straps being connected to the second end of the other shoulder strap and to said bracing means and being located immediately adjacent the rear of the neck of the bearer when said carrier is worn by the bearer such that said midline axis of said half sections lies substantially at the same level as the armpits of the bearer and such that the head of the baby is supported such that it is in a face-to-face relationship with the bearer; and each of said underarm straps having an adjustable length and having first and second ends, each of said first ends of said underarm straps being detachably connected to said lower portion of said carrier adjacent to one of said leg openings and extending in a substantially horizontal manner above the breasts of the bearer and each of said second ends of said underarm straps being connected to said bracing means.

2. The baby carrier of claim 1 wherein the distance between the location of the second end of each said shoulder strap immediately adjacent the rear of the neck of the bearer and said leg openings is approximately 38 centimeters.

3. The baby carrier of claim 1 wherein the first end of each said shoulder strap is connected to said pouch by means of sewing.

4. The baby carrier of claim 1 wherein the second end of each said shoulder strap is connected to said bracing means by means of sewing.

5. The baby carrier of claim 1 wherein the central closure is severable and joinable from said upper portion to said lower portion adjacent an area between said leg openings.

6. The baby carrier of claim 1 further including a baby head support comprising an elongated section of material having a first end which includes a first fastening means attachable to a second fastening means which is located where the second end of each said shoulder strap is connected to said bracing means and a second end which includes a third fastening means attachable to a fourth fastening means located upon the upper portion of each said half section whereby the second end of the elongated section may be selectively attached to either of said half sections.

7. The baby carrier of claim 6 wherein the first fastening means is positioned on said elongated section such that said first fastening means is hidden from view when attached to said second fastening means.

8. The baby carrier of claim 6 wherein said elongated section is substantially comprised of a mesh material.

9. The baby carrier of claim 6 wherein said elongated section includes a means for adjusting the length thereof such that the head of the baby may be drawn closer to the body of the bearer.

10. The baby carrier of claim 1 wherein said bracing means and said underarm straps are visually distinguishable.

11. The baby carrier of claim 1 wherein said bracing means includes a peaked top, said peaked top overlapping each said second end of said shoulder straps.

12. The baby carrier of claim 1 wherein each of said shoulder straps extends from said bracing means in a substantially perpendicular relationship to thereby resist the tendency of each said shoulder strap to edge upward and squeeze against the neck of the bearer in response to the downward force of the baby within said pouch.

13. A baby carrier for carrying a baby on a bearer's body such that the baby and the bearer are situated in a face-to-face relationship, said carrier comprising:

a flexible pouch, a bracing means, a pair of shoulder straps, a pair of underarm straps and at least one lifting strap;

said pouch having a substantially close fitting interior for supporting the baby therein in a substantially seated position facing the bearer, said pouch comprising first and second longitudinal half sections which are at least partially severable and joinable along a central closure, each half section being divisible along a substantially horizontal midline axis into an upper portion and a lower portion, said lower portion having leg openings therein and said upper portion defining a head and back support for the baby therein, said pouch further comprising a pair of extension straps each being substantially laterally joined to said upper portion of respective half sections of said pouch;

said bracing means extendable about the back of the bearer;

each of said shoulder straps being of equal, fixed length and having first and second ends, the first end of each said shoulder strap being connected to said upper portion of said pouch and extending upwardly therefrom, the second end of one of said shoulder straps being connected to the second end of the other shoulder strap and to said bracing means and being located immediately adjacent the rear of the neck of the bearer when said carrier is worn by the bearer such that said midline axis of said half sections lies substantially at the same level as the armpits of the bearer and such that the head of the baby is supported such that it is in a face-to-face relationship with the bearer;

each of said underarm straps having an adjustable length and having first and second ends, each of said first ends of the underarm straps being detachably connected to said lower portion of said carrier adjacent to one of said leg openings and extending in a substantially horizontal manner above the breasts of the bearer and each of the second ends of said underarm straps being connected to said bracing means; and said at least one lifting strap being adjustable and having one end which is joined to said extension strap and a second end which is diagonally joined to said lower portion such that when the length of said at least one lifting strap is shortened, the position of the baby within said pouch is changed.

14. The baby carrier of claim 13 wherein each of said half sections includes an approximately rectangular side panel which is bordered on the top thereof by one of said extension straps, on the bottom thereof by one of said leg openings, on one side thereof by one of said shoulder straps and on another side thereof by said upper and lower portions of a respective half section.

15. The baby carrier of claim 14 wherein each of said side panels is substantially comprised of a mesh material.

* * * * *